US006692309B1

(12) United States Patent
Kovacs

(10) Patent No.: US 6,692,309 B1
(45) Date of Patent: Feb. 17, 2004

(54) MERCURY VAPOR LAMP ELECTRICAL CONNECTOR

(75) Inventor: George Kovacs, Wallingford, CT (US)

(73) Assignee: Light Sources, Inc., Orange, CT (US)

( * ) Notice: Subject to any disclaimer, the term of this patent is extended or adjusted under 35 U.S.C. 154(b) by 0 days.

(21) Appl. No.: 10/402,509

(22) Filed: Mar. 28, 2003

(51) Int. Cl.[7] ..... H01R 24/00

(52) U.S. Cl. ..... 439/699.2; 439/356; 439/226; 439/753; 439/419; 439/619; 439/854; 313/318.01

(58) Field of Search ..... 439/699.2, 699.1, 439/854, 419, 619, 356, 753, 226, 242; 313/318.01

(56) References Cited

U.S. PATENT DOCUMENTS 1,722,915 A 7/1929 Hendry
2,883,639 A 4/1959 Kulka
3,058,084 A 10/1962 Cutler
4,100,448 A 7/1978 Chipner et al.
4,804,343 A * 2/1989 Reedy ..... 439/854
6,224,428 B1 * 5/2001 Chen et al. ..... 439/694
6,250,970 B1 * 6/2001 Key et al. ..... 439/699.2

* cited by examiner

*Primary Examiner*—Truc Nguyen
(74) *Attorney, Agent, or Firm*—Robert A. Seemann

(57) ABSTRACT

A connector includes a tubular wall on a first body containing a lamp envelope, coaxially receiving an insulating tube mounted on a second body having a cavity that receives the first body, spring metal strip terminals on the outside of the tubular wall in resilient contact with spring metal strip terminals on the inside of the cavity, and microprocessor controlled heated and cooled air delivered to the lamp envelope by way of the insulating tube in response to a sensor that monitors at least one of lamp amalgam temperature and lamp radiation.

17 Claims, 7 Drawing Sheets

MERCURY VAPOR LAMP ELECTRICAL CONNECTOR

BACKGROUND OF THE INVENTION

1. Field of the invention

The invention relates to a two-part electrical connector for a flourescent lamp, more specifically to a connector assembly that receives a lamp envelope in one body of the connector that inserts into another body and locks against rotation within the other body, and by engagement of electrical contacts on the two bodies locks axially with the other body of the connector, the bodies comprising concentric tubes forming an axial passageway through the connector for delivering heating or cooling gas through the connector to the lamp envelope.

2. Description of the Prior Art

U.S. Pat. No. 4,100,448 patented Jul. 11, 1978 by Chipner et al. describes a lamp base containing a lamp envelope. The base is axially received in an annular socket collar that is more flexible than the lamp base. The depth of the base in the socket collar is limited by an annular radially outward extending ring on the base resting on a radially inward extending annular ring within the collar. Prongs associated with electrical pins on the lamp base that are connected to the lamp wires, catch under the annular ring within the collar preventing axial withdrawal of the base from the collar. The socket collar snaps onto an electrical supply connector by way of an annular groove around the connector. Conductive tabs which extend axially upward from a wall that seals the bottom of the electrical supply connector make radial outward contact with the lamp base electrical pins which extend into the electrical supply connector.

SUMMARY OF THE INVENTION

It is one object of the invention to provide a connector for a flourescent lamp that receives a lamp envelope in a first body that is axially, slidingly received in a second, electrical supply, body.

It is another object of the invention that temperature controlling fluid is delivered to a lamp in the first body by way of a conduit through the first and second body.

A connector includes a first body comprising a first end, a second end, and a first axis extending through said first end and said second end, means on said first end adapted for receiving a lamp, a first wall on said first body extending axially from said second end along a length of said first body toward said first end, a first axial tubular opening having a third end and a fourth end, extending through said first wall, a first metal electrical contact strip extending axially along an outer surface of said first wall, a fifth end of said strip extending radially over said first wall at said second end adjacent to said third end of said first axial tubular opening, a sixth end of said strip comprising means for attaching electrical wire from said lamp to said strip, extending radially over said first wall adjacent to said fourth end of said first axial tubular opening, a second body comprising a seventh end and an eighth end, a cavity extending axially into said second body from an opening in said seventh end, receiving said first wall in said second body, an electrically non-conductive tube having a ninth end open through said eighth end, extending axially along a length of said second body in said cavity toward said seventh end, in said first axial tubular opening, coaxial with said first axial tubular opening, a second metal electrical contact strip extending from said eighth end, axially along a length of said second body in said cavity toward said seventh end, in radially inward contact of said second strip with said first metal contact strip, a lamp mounted in said first end, fluid conduit means connected to the ninth end of said electrically non-conductive tube, a fluid in contact with said lamp, moving in said conduit means, means for sensing at least one of radiation from the lamp and temperature of the lamp, microprocessor controlled fluid heating means connected to the means for sensing and to the fluid conduit means, responsive to the means for sensing for controlling temperature of the lamp by the fluid, said first metal electrical contact strip extending axially along said first wall in a longitudinal radially open recess. At least one of said first strip and said second strip is resilient, the first and second strips contacting in said recess. Three faces about the first axis on the outer surface of said first wall, including at least one face of said three faces on each side of said first metal electrical contact strip, comprising an asymmetrical pattern when viewed axially, each face of said three faces in radially opposed adjacency to a face on an inner surface of said cavity.

Other objects and advantages of the invention will be apparent to one from reading the ensuing description of the invention.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
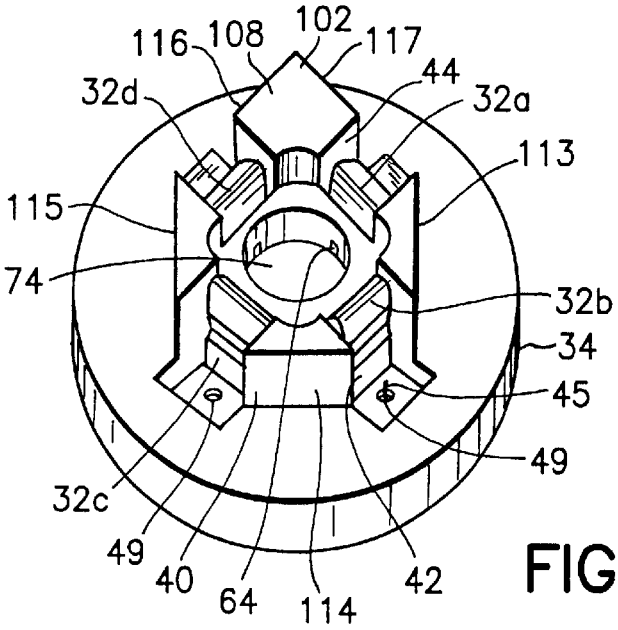
FIG. 1 is a top perspective view of the lamp envelope receiving body of the connector assembly.
Figure 2:
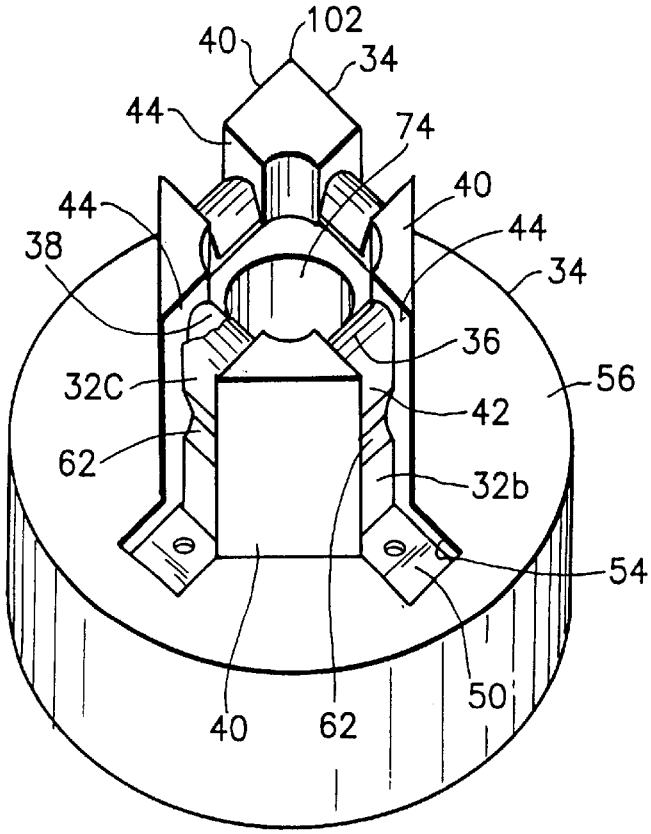
FIG. 2 is a front perspective view of the body of FIG. 1.
Figure 3:
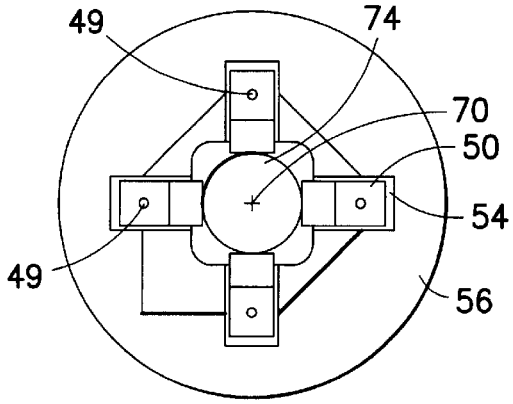
FIG. 3 is a top schematic view of the body of FIG. 1.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to FIGS. 1–5, 11 and 12, spring metal contact strips 32*a*, 32*b*, 32*c*, and 32*d*, are similar to each other in shape and in how they mount on one-piece molded rigid plastic or ceramic body 34.

Top 36 of spring 32*b* wraps over an edge 38 of vertical wall 40 in recess 44 of the wall. Edge 38 is shown adjacent to cut-away view of contact 32*c* in FIG. 2.

Bottom 64 of spring metal contact strip 32*b* wraps over edge 68 of vertical ridge portion 77 that separates hole 54 from tubular opening 74.

Hollow 58 is designed to receive lamp envelope 46 which is glued to inner wall 66 of the shell.

Lamp envelope 46 may contain an amalgam which is included in many present mercury vapor lamps to control the amount of mercury vapor in the lamp by taking in or releasing mercury vapor. One amalgam that is widely used in present mercury vapor lamp manufacture is indium plus mercury. It is known that the amount of mercury vapor in a lamp envelope can be controlled by cooling or heating the amalgam, hereinafter called the mercury vapor control amalgam. The amount of mercury vapor may also be controlled by cooling or heating the envelope.

Tubular opening 74 formed through vertical wall 40 provides a conduit to the lamp envelope for cooling or heating gas for changing the temperature of the mercury vapor control amalgam 52 in the envelope or a portion of the envelope at the shell.

Electrical terminal 48 of strip 32*b* receives one of the wires 45 from the lamp envelope in terminal hole 49 (FIG. 1). Terminal hole 49 extends through U-fold 78 of the spring. U-fold 78 comprises bottom portion 50 of the spring which extends through hole 54 in horizontal top 56 of hollow 58 shell 60 portion of body 34.

Referring to FIGS. 6–11, spring metal contact strips 80*a*, 80*b*, 80*c*, and 80d in recess 99 of housing 92, are similar to each other in shape and in how they mount on body 84.

Body 84 is preferably one piece plastic or ceramic, and is preferably rigid. Body 84 comprises tube 90 which extends from bottom wall 112 into housing 92, and preferably extends through bottom wall 112.

In another preferred embodiment body 84 comprises a ceramic high voltage insulation tube 90 fixedly mounted in a rigid plastic housing 92.

Tube 90 provides a conduit to the lamp enclosure for the cooling or heating gas.

Figure 13:
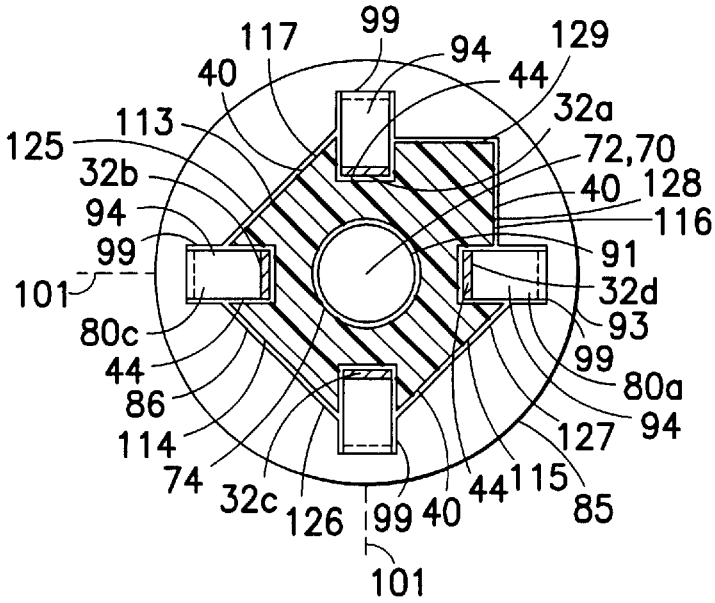
FIG. 13 is a cross section view taken at the top of the body of FIG. 12, of the body of FIG. 12 receiving the body of FIG. 1.

Cavity 86 of hollow shell 88 is designed to receive vertical wall 40 of body 34 so that tube 90 of body 84 extends into tubular opening 74 in body 34, concentric with tubular opening 74, axis 70 and 72 preferably coinciding when body 34 is inserted into body 84. In FIG. 13, body 34 is inserted into body 85 which but for sealed rod 91 is similar to body 84.

The concentric tubes form an axial passageway through the assembled bodies for delivering heating or cooling gas through the assembled bodies to the lamp envelope.

Figure 12:
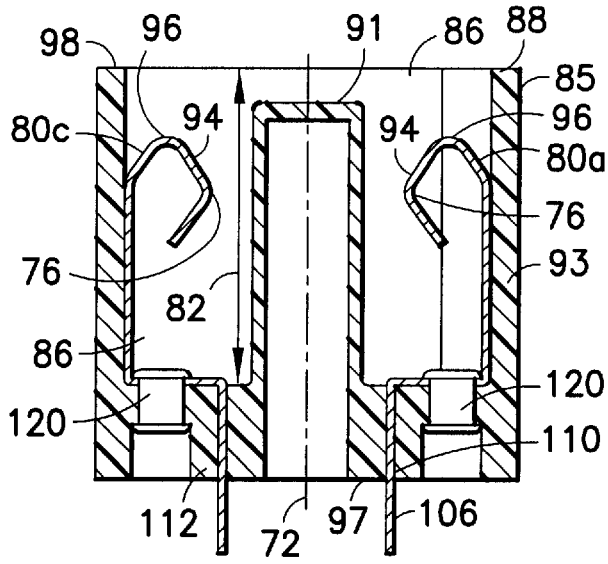
FIG. 12 is a cross section view of another body of the invention that receives the body of FIG. 1.

In another preferred embodiment of the invention, a sealed element is used. Preferably the element is hollow. A hollow, sealed rod 91 is shown in FIG. 12 described later herein.

When body 34 is inserted axially into body 84, horizontal radially inward extending crease 62 on outer contact surface 42 of contact strip 32*b* slides over and locks against horizontal radially inward extending crease 76 on inner contact surface 94 of the C-fold 96 in contact strip 80*c*, and bodies 34 and 84 are aligned rotationally about axis 70 and axis 72 by radially outward angular portion 102 of vertical wall 40 in radially outward angular groove 104.

Electrical wiring connection end 106 of spring 80*a* extends through slot 110 in bottom wall 112. Each contact strip 80 is prevented from being pulled out of cavity 86 by rivets 120. Connection end 106 is wired to an electrical supply which is not shown.

Figure 11:
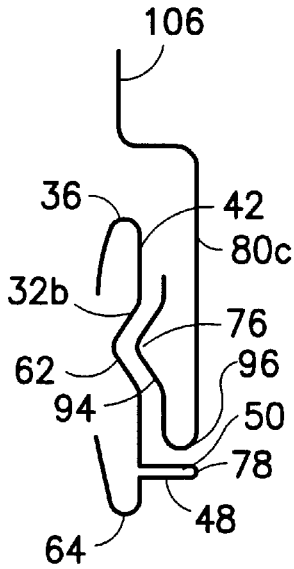
FIG. 11 is a schematic view of the spring metal contact strips of the bodies of FIGS. 1 and 6 locking together.

Referring to FIG. 11, springs 32*b* and 80*c* are in locking alignment against axial movement of one of spring metal contact strip 32*b* and 80*c* along the other. Strips 32*b* and 80*c* are shown spaced apart for clarity of illustration.

Referring to FIGS. 12 and 13, in body 85, the same numbers are applied to like elements which are in body 84. Rod 91 which extends from end 97 toward end 98 closely fits into tubular opening 74 when body 34 is received in body 85.

Each recess 99 is on a radial line 101 with a recess 44.

Radially inward extending crease 76 preferably extends into recess 44 of wall 40 where it contacts crease 62.

Faces 113, 114, 115, 116, and 117 between recesses 44 in wall 40 are parallel to faces 125, 126, 127, 128 and 129 respectively between recesses 99 in housing 93. The asymmetrical shape of the faces on wall 40 permit inserting wall 40 in cavity 86 in only one position rotationally about axis 72.

Preferably, radially adjacent surfaces of assembled body 34 in body 84 are spaced from each other such that the adjacent surfaces do not interfere axially with each other or with axially passing strip 32*b* or 80*c* to prevent axial separation of the bodies when body 34 is withdrawn from body 84. Prevention of axial separation of the bodies is performed preferably solely by the engagement of crease 76 in crease 62.

Figure 4:
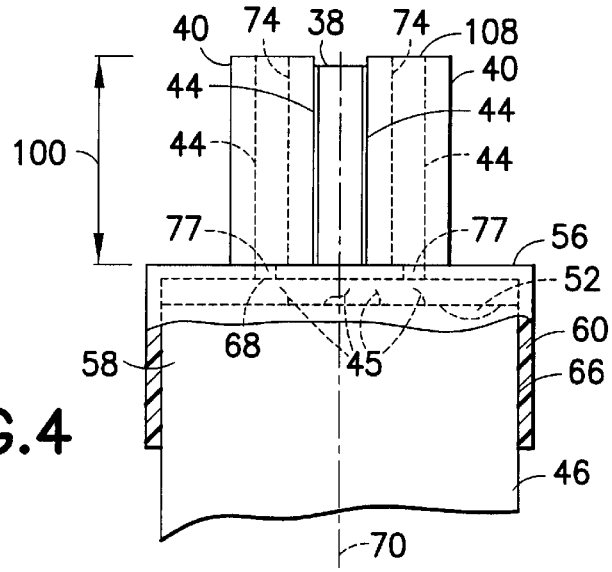
FIG. 4 is a front schematic view of the body of FIG. 1 less the contact strips, including a lamp envelope.
Figure 5:
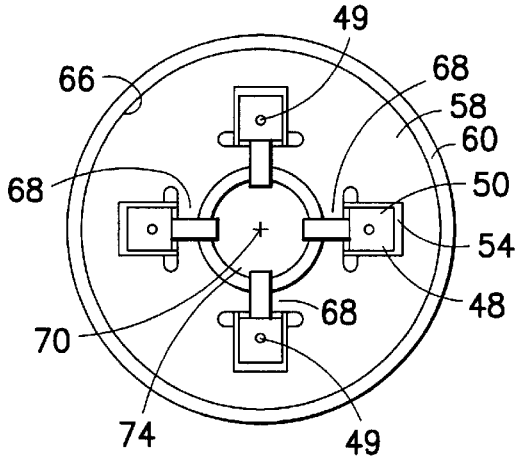
FIG. 5 is a bottom schematic view of the body of FIG. 1.
Figure 6:
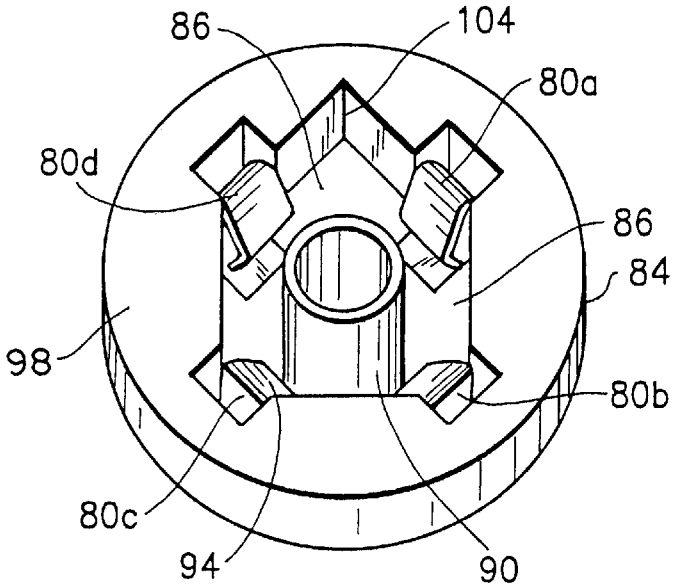
FIG. 6 is a top perspective view of the electrical supply body of the connector assembly.
Figure 7:
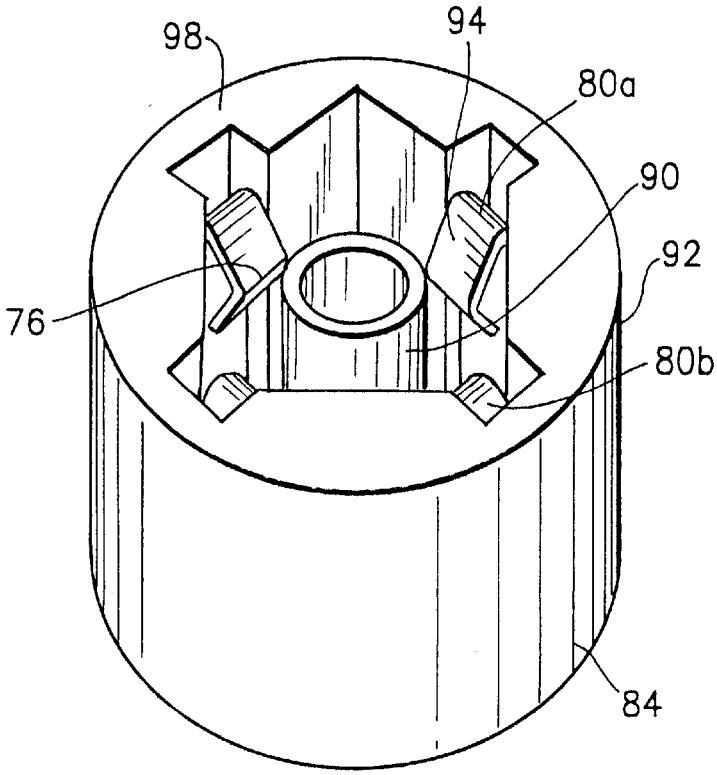
FIG. 7 is a front perspective view of the body of FIG. 6.
Figure 8:
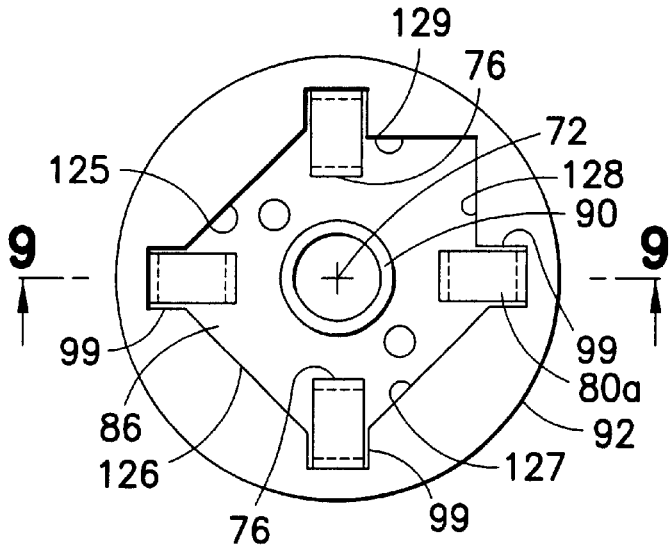
FIG. 8 is a top schematic view of the body of FIG. 6
Figure 9:
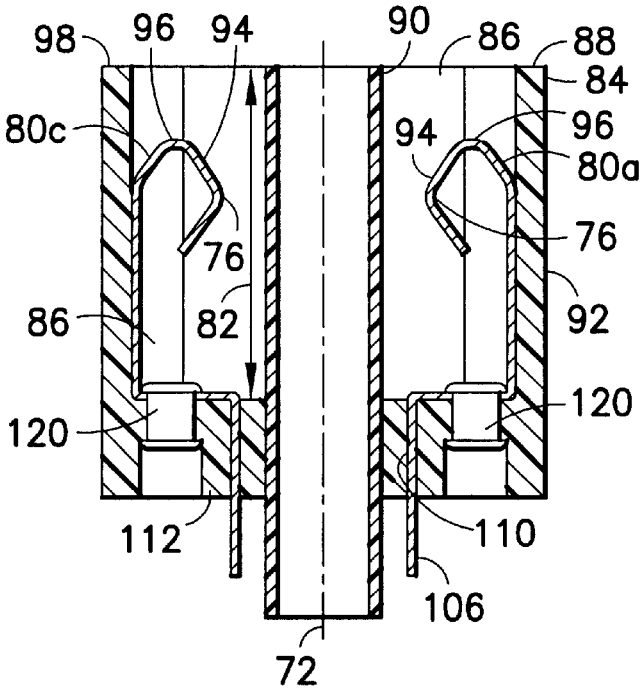
FIG. 9 is a cross section view of the body of FIG. 8 taken along 9—9.
Figure 10:
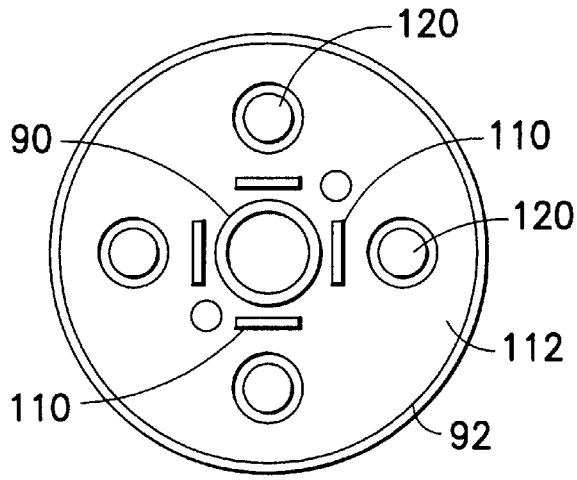
FIG. 10 is a bottom schematic view of the body of FIG. 6.
Figure 14:
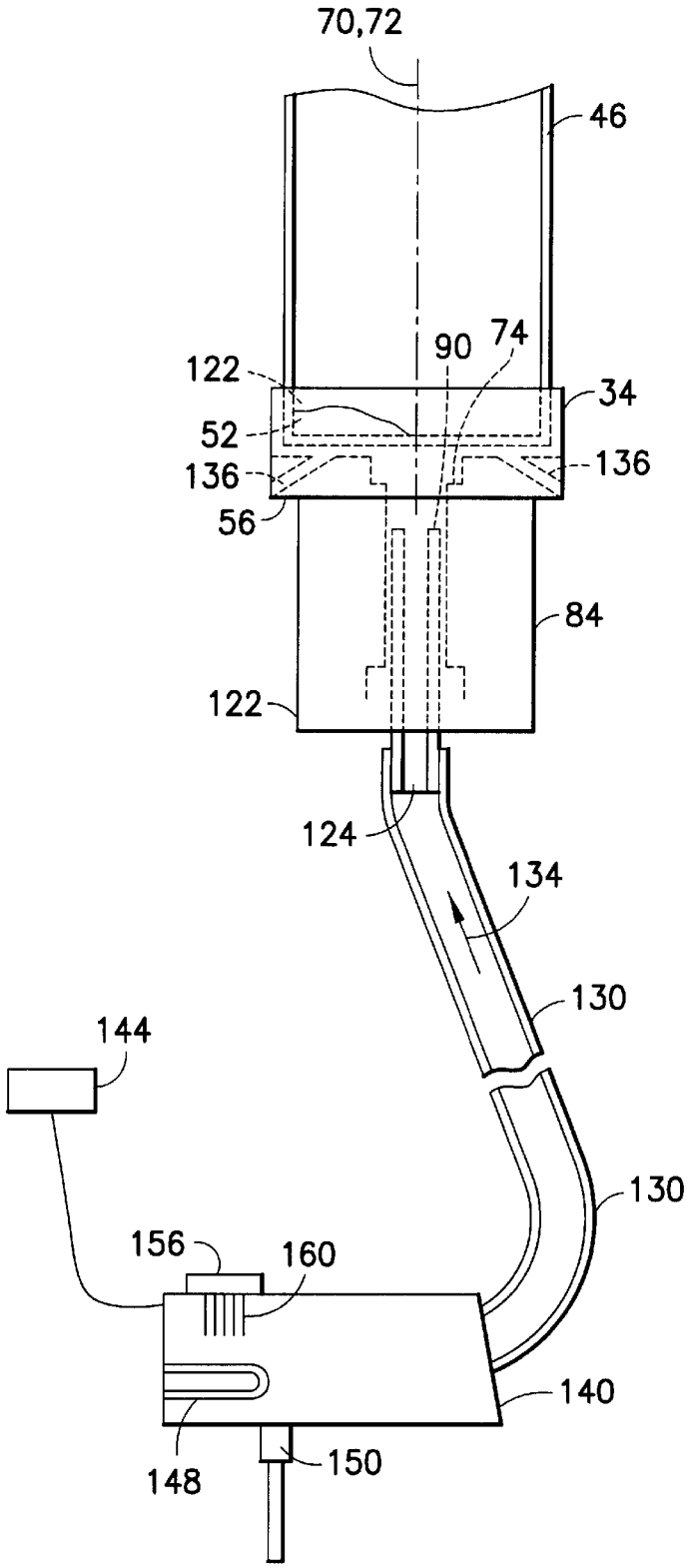
FIG. 14 is a front schematic view of a connector of the invention comprising the bodies of FIGS. 1 and 6.

Referring to FIGS. 4, 9, and 12, length 100 of wall 40 from end 108 of wall 40 to horizontal top 56 of shell 60 is less than the depth 82 of cavity 86 from end 98 of body 84 and of body 85. Preferably the distance of crease 62 from horizontal top 56 and the distance of crease 82 from end 98 is such that when crease 82 is in crease 62, the engagement of the creases holds end 98 of body 84 spaced axially from horizontal top 56, that is, the axial surfaces of body 84 are spaced axially from body 34 when body 34 is mounted on body 84. In FIG. 14, connector 122 comprises assembled bodies 34 and 84. Passageway 124 of concentric tubular opening 74 and tube 90 delivers temperature control gas 134 from supply tube 130 to lamp envelope 46.

Temperature control gas impinging on lamp envelope 46 exits the connector preferably by way of passageways 136.

Exit passageway may be provided by space between the tube and body 34 or other ways.

Temperature control gas supply microprocessor controlled module 140 heats or cools gas to control lamp envelope or amalgam temperature in response to sensor 144 which preferably monitors lamp radiation. Sensor 144 may be mounted in contact with the lamp for measuring temperature of the envelope or amalgam by thermal conduction.

Heating and cooling respectively of the gas is provided preferably by an electric resistance heating element 148, and by compressed gas received by way of an electrically controlled valve 150.

Heating and cooling may be provided by air passed through filter 156 and over an array of peltier effect junctions 160 which are supplied electrical power in which current flow direction is switched for heating or cooling at the junctions.

While preferred embodiments of the invention have been shown and described, it will be understood that the invention may be embodied otherwise than as herein specifically illustrated or described, and that certain changes in form and arrangement of parts and in the specific manner of practicing the invention may be made without departing from the underlying idea or principles of this invention within the scope of the appended claims. Drawing Designators of the Formal Drawings (Informal list)

32*a* spring metal contact strip
32*b* spring metal contact strip
32*c* spring metal contact strip
32*d* spring metal contact strip
34 molded plastic or ceramic body
36 top of spring
38 edge
40 vertical wall
42 outer contact surface of contact strip 32*b*
44 recess in vertical wall 40
45 lamp envelope wires
46 lamp envelope
48 electrical terminal
49 terminal hole
50 bottom portion of spring 32
52 mercury vapor control amalgam 52 in the tube
54 hole
56 horizontal top
58 hollow
60 shell
62 crease, horizontal radially inward extending
64 bottom of spring metal contact strip 32*b*
68 edge
66 inner wall
70 axis
72 axis
74 tubular opening
76 crease, horizontal radially inward extending
77 vertical ridge portion
78 U-fold
80*c* spring metal contact strip
80*d* spring metal contact strip
80*b* spring metal contact strip
80*a* spring metal contact strip
82 depth of cavity 86
84 molded plastic body
85 body
86 cavity
88 hollow shell
90 tube
91 rod
92 housing
94 inner contact surface of contact strip
96 C-fold
97 end of body 84
98 end of body 84
99 recess
100 length of wall 40
101 radial line
102 radially outward angular portion
104 radially outward angular groove
106 electrical wiring connection end
108 end of wall 40
110 slot
112 bottom wall
113 face
114 face
115 face
116 face
117 face
120 rivet
122 connector
124 passageway
125 face
126 face
127 face
128 face
129 face
130 supply tube
134 gas
136 passageway
140 supply module
144 sensor
148 heating element
150 valve
156 filter
160 peltier effect junction array

I claim:

1. A connector comprising:

a first body comprising a first end, a second end, and a first axis extending through said first end and said second end, means on said first end adapted for receiving a lamp, a first wall on said first body extending axially from said second end along a length of said first body toward said first end, a first axial tubular opening having a third end and a fourth end, extending through said first wall, a first metal electrical contact strip extending axially along an outer surface of said first wall, a fifth end of said strip extending radially over said first wall at said second end adjacent to said third end of said first axial tubular opening, a sixth end of said strip comprising means for attaching electrical wire from said lamp to said strip, extending radially over said first wall adjacent to said fourth end of said first axial tubular opening, a second body comprising a seventh end and an eighth end, a cavity extending axially into said second body from an opening in said seventh end, receiving said first wall in said second body, an electrically non-conductive rod, extending axially from said eighth end along a length of said second body in said cavity toward said seventh end, in said first axial tubular opening, a second metal electrical contact strip extending from said eighth end, axially along a length of said second body in said cavity toward said seventh end, in radially inward contact of said second strip with said first metal contact strip.

2. The connector of claim 1 further comprising:

said first metal electrical contact strip extending axially along said first wall in a first longitudinal radially outward open recess, from the extending of said first metal strip radially over said first wall adjacent to said third end to the radial extending of said first metal strip over said first wall adjacent to said fourth end.

3. The connector of claim 2 further comprising:

at least one of said first strip and said second strip is resilient, the first and second strips contacting each other in said recess.

4. The connector of claim 1 further comprising:

a radial crease on said first strip being in engagement with a radial crease on said second strip, radially adjacent surfaces of assembled body in body are spaced from each other such that the adjacent surfaces do not interfere axially with each other or with axial passage of strip or such that they prevent axial separation of the bodies when body is withdrawn from body so that prevention of axial separation of the bodies is performed solely by the engagement of crease in crease.

5. The connector of claim 1 further comprising:

said second metal electrical contact strip extending axially in a second longitudinal radially inward open recess in said second body on a radial line with said first radially inward open recess.

6. The connector of claim 1 further comprising:

three faces about the first axis on the outer surface of said first wall, including at least one face of said three faces on each side of said first metal electrical contact strip, comprising an asymmetrical pattern when viewed axially, each face of said three faces in radially opposed adjacency to a face on an inner surface of said cavity.

7. The connector of claim 1 further comprising:

said rod comprising an opening axially through said rod through said eighth end.

8. A connector comprising:

a first body comprising a first end, a second end, and a first axis extending through said first end and said second end, means on said first end adapted for receiving a lamp, a first wall on said first body extending axially from said second end along a length of said first body toward said first end, a first axial opening extending into said first wall from said second end, a first metal electrical contact strip extending axially along an outer surface of said first wall comprising means for attaching electrical wire from said lamp to said strip, a second body comprising a third end and a fourth end, a cavity extending axially into said second body from an opening in said third end, receiving said first wall in said second body, an electrically non-conductive rod, extending axially from said fourth end along a length of said second body in said cavity toward said third end, in said first axial tubular opening, a second metal electrical contact strip extending from said fourth end, axially along a length of said second body in said cavity toward said third end, in radially inward contact of said second strip with said first metal contact strip.

9. The connector of claim 8 further comprising:

three faces about the first axis on the outer surface of said first wall, including at least one face of said three faces on each side of said first metal electrical contact strip, comprising an asymmetrical pattern when viewed axially, each face of said three faces in radially opposed adjacency to a face on an inner surface of said cavity.

10. A connector comprising:

a first body comprising a first end, a second end, and a first axis extending through said first end and said second end, means on said first end adapted for receiving a lamp, a first wall on said first body extending axially from said second end along a length of said first body toward said first end, a first axial tubular opening having a third end and a fourth end, extending through said first wall, a first metal electrical contact strip extending axially along an outer surface of said first wall so that a fifth end of said strip is adjacent to said third end of said first axial tubular opening and a sixth end of said strip comprising means for attaching electrical wire from said lamp to said strip is adjacent to said fourth end of said first axial tubular opening, a second body comprising a seventh end and an eighth end, a cavity extending axially into said second body from an opening in said seventh end, receiving said first wall in said second body, an electrically non-conductive rod, extending axially from said eighth end along a length of said second body in said cavity toward said seventh end, in said first axial tubular opening, a second metal electrical contact strip extending from said eighth end, axially along a length of said second body in said cavity toward said seventh end, in radially inward contact of said second strip with said first metal contact strip.

11. The connector of claim 10 further comprising:

three faces about the first axis on the outer surface of said first wall, including at least one face of said three faces on each side of said first metal electrical contact strip, comprising an asymmetrical pattern when viewed axially, each face of said three faces in radially opposed adjacency to a face on an inner surface of said cavity.

12. The connector of claim 10 further comprising:

said rod comprising an opening axially through said rod through said eighth end.

13. A connector comprising:

a first body comprising a first end, a second end, and a first axis extending through said first end and said second end, means on said first end adapted for receiving a lamp, a first wall on said first body extending axially from said second end along a length of said first body toward said first end, a first axial tubular opening having a third end and a fourth end, extending through said first wall, a first metal electrical contact strip extending axially along an outer surface of said first wall so that a fifth end of said strip is adjacent to said third end of said first axial tubular opening and a sixth end of said strip comprising means for attaching electrical wire from said lamp to said strip is adjacent to said fourth end of said first axial tubular opening, a second body comprising a seventh end and an eighth end, a cavity extending axially into said second body from an opening in said seventh end, receiving said first wall in said second body, an electrically non-conductive tube having a ninth end open through said eighth end, extending axially along a length of said second body in said cavity toward said seventh end, in said first axial tubular opening, a second metal electrical contact strip extending from said eighth end, axially along a length of said second body in said cavity toward said seventh end, in radially inward contact of said second strip with said first metal contact strip, a lamp mounted in said first end, fluid conduit means connected to the ninth end of said electrically non-conductive tube, and a fluid in contact with said lamp, in said conduit means.

14. The connector of claim 13, further comprising:

means for sensing at least one of radiation from the lamp and temperature of the lamp, microprocessor controlled fluid heating means connected to the means for sensing and to the fluid conduit means, responsive to the means for sensing for controlling temperature of the lamp by the fluid.

15. The connector of claim 13, further comprising:

said first metal electrical contact strip extending axially along said first wall in a longitudinal radially open recess.

16. The connector of claim 13, further comprising:

at least one of said first strip and said second strip is resilient, the first and second strips contacting in said recess.

17. The connector of claim 13, further comprising:

three faces about the first axis on the outer surface of said first wall, including at least one face of said three faces on each side of said first metal electrical contact strip, comprising an asymmetrical pattern when viewed axially, each face of said three faces in radially opposed adjacency to a face on an inner surface of said cavity.

* * * * *